United States Patent [19]

Wieland

[11] Patent Number: 4,895,073

[45] Date of Patent: Jan. 23, 1990

[54] SHEET TURN-OVER ASSEMBLY

[75] Inventor: Erich G. Wieland, Würzburg, Fed. Rep. of Germany

[73] Assignee: Koenig & Bauer Aktiengesellschaft, Würzburg, Fed. Rep. of Germany

[21] Appl. No.: 265,335

[22] Filed: Oct. 24, 1988

Related U.S. Application Data

[63] Continuation of Ser. No. 86,551, Aug. 18, 1987, abandoned.

[30] Foreign Application Priority Data

Aug. 26, 1986 [DE] Fed. Rep. of Germany ..... 3628907

[51] Int. Cl.[4] ..... B41F 21/06

[52] U.S. Cl. ..... 101/409; 271/82; 271/277

[58] Field of Search ..... 101/246, 408, 409, 411, 101/233; 271/82, 277

[56] References Cited

U.S. PATENT DOCUMENTS

| | | | |
|---|---|---|---|
| 3,116,923 | 1/1964 | Gunther | 271/82 X |
| 3,992,993 | 11/1976 | Kuhn et al. | 271/82 X |
| 4,018,161 | 4/1977 | Johne et al. | 271/82 X |
| 4,097,512 | 10/1987 | Simeth | 271/82 X |
| 4,132,403 | 1/1979 | Weisbach et al. | 101/246 X |
| 4,290,595 | 9/1981 | Thünker | 101/409 X |
| 4,295,422 | 10/1981 | Thünker | 101/409 X |
| 4,357,870 | 11/1982 | Rudolph et al. | 271/82 X |
| 4,583,728 | 4/1986 | Mathes | 271/277 X |
| 4,699,368 | 10/1987 | Hirosho et al. | 271/82 |

FOREIGN PATENT DOCUMENTS

| | | | |
|---|---|---|---|
| 2133693 | 12/1974 | Fed. Rep. of Germany | 101/408 |
| 2708478 | 11/1981 | Fed. Rep. of Germany | 101/408 |
| 2451987 | 1/1982 | Fed. Rep. of Germany | 101/408 |

*Primary Examiner*—Eugene H. Eickholt
*Attorney, Agent, or Firm*—Jones, Tullar & Cooper

[57] ABSTRACT

A sheet turn-over assembly includes at least one cooperating pair of first and second sheet gripper sets. Each set has coacting sheet gripper fingers and sheet gripper abutment surfaces. These fingers and abutment surfaces in each set are carried on coaxially aligned rotatable shafts. Movement of one shaft with respect to the other accomplishes sheet gripping and release. Movement of the coaxial shafts of each gripper set with respect to the cooperating set accomplishes sheet turn-over.

1 Claim, 3 Drawing Sheets

SHEET TURN-OVER ASSEMBLY

This application is a continuation, of application Ser. No. 086,551, filed Aug. 18, 1987, now abandoned.

FIELD OF THE INVENTION

The present invention is directed generally to a sheet turn-over assembly. More particularly, the present invention is directed to a sheet turn-over assembly in a sheet-fed rotary printing apparatus. Most specifically, the present invention is directed to a sheet turn-over assembly for a sheet transfer apparatus positioned between two printing units in a sheet fed rotary printing apparatus. A sheet turn-over drum carries at least a first cooperating pair of gripper sets each of which has coacting gripper fingers and sheet abutment surfaces. Each of these two sheet gripping sets is rotatable on the surface of the sheet turn-over drum. Cooperation of the two sheet gripping sets facilitates the transfer of a sheet, which has been printed on a first side, from a sheet storage drum and delivery of the sheet in a turned-over orientation to a second printing unit thereby allowing the sheet to be printed on both sides.

DESCRIPTION OF THE PRIOR ART

In various printing press assemblies, a sheet turn-over device is placed between first and second printing units so that both sides of each sheet of paper may be printed. Often these sheet turn-over devices receive the sheets, which have been printed on one side, from a storage drum and then deliver the sheet to the second printing unit, after having inverted them so that the second sides can be printed.

German Published Patent Application No. DE-AS 21 33 693 discloses a turn-over drum assembly which is equipped with two sheet gripper devices for use in turning over sheets. Each of these sheet grippers consists of two shafts; one of which carries a plurality of adjacent sheet gripper abutment surfaces; and the other of which carries a plurality of gripper fingers that act on these gripper abutment surfaces. When a sheet turn-over is to be performed, both gripper devices together pivot around a pivot axis of the gripper abutment shaft. During opening of the gripper devices for transferring or accepting sheets, the gripper fingers also pivot around a pivot axis of the gripper finger shaft which is disposed at a distance from the pivot axis of the gripper abutment shaft.

In sheet turn-over devices of this type is is necessary to keep the size of the pivot shafts for the sheet gripper fingers quite small since these shafts pivot about the pivot axis of the sheet abutment surface. This is important so that gravitational forces acting on the sheet gripper finger shafts do not become too large. This requirement for small sheet gripper finger shafts however results in a reduction of shaft stability and also in a reduction of the torsional rigidity of the shaft and hence the ability of the sheet gripper assembly to grasp and hold the sheets in the sheet turn-over device.

In German Patent No. 27 08 478 there is disclosed a sheet turn-over device in which only one gripper device is provided for turning the printed sheets. This gripper device consists of two hollow shafts which are coaxial one within the other. On one of these shafts are fixed a plurality of gripper abutment surfaces, while the other shaft carries gripper fingers that cooperate with the gripper abutment surfaces. When an opening movement of the gripper device is to be performed, the gripper fingers pivot around a common axis for the two coaxially disposed shafts. When a combined pivotal movement of the gripper abutment surfaces and the gripper fingers is to be accomplished for turning a sheet, both coaxial shafts move outwardly on a curved path.

In a sheet turn-over assembly of the type generally as disclosed in the above discussed patent, there is a shifting of weight with each pivotal motion of the gripper device. This shifting of weight creates centrifugal forces which reduce the speed at which such a sheet turn-over device can operate. Thus the printing production speed is limited by the speed of the sheet turn-over device. The first printing unit can run at high speeds but the second printing unit cannot, as its speed is limited by the speed of the sheet turn-over assembly whose speed is, as discussed above, limited by the centrifugal forces caused by movement of the gripper pairs in their curved path outwardly from the surface of the sheet turn-over drum. These centrifugal forces can be eliminated by means of various compensation devices. However, these devices are quite expensive and often are subject to mechanical failures.

While it is desirable to be able to turn a sheet over between first and second spaced pringint units for printing on both sides, this has not been easily accomplished in a rapid, efficient manner. The sheet turn-over assembly of the present invention however provides an assembly which accomplishes sheet turn-over in a manner far superior to prior devices.

SUMMARY OF THE INVENTION

It is an object of the present invention to provide a sheet turn-over assembly.

Another object of the present invention is to provide a sheet turn-over assembly for a sheet fed rotary printing apparatus.

A further object of the present invention is to provide a sheet turn-over assembly for a sheet transfer apparatus in a sheet fed rotary printing apparatus.

Yet another object of the present invention is to provide a sheet turn-over assembly having spaced sheet gripping assemblies.

Still a further object of the present invention is to provide a sheet turn-over assembly which has torsionally stiff shafts that do not generate disruptive centrifugal forces.

Even another object of the present invention is to provide a sheet turn-over assembly that is capable of high speed operation.

Still yet a further object of the present invention is to provide a sheet turn-over assembly which is efficient and dependable.

As will be discussed in greater detail in the description of the preferred embodiment which is set forth subsequently, the sheet turn-over assembly of the present invention includes a sheet turn-over drum which is placed in a sheet transport assembly between a sheet storage drum, that receives printed sheets from a first printing unit, and a second printing unit which receives the turned over sheets from the turn-over drum. The sheet turn-over drum carries at least one cooperating pair of adjacent, coacting sheet gripper sets. Each set has sheet abutment surfaces and sheet gripper fingers. In each such set, the abutment surfaces and gripper fingers are carried on coaxial shafts. These coaxial shafts are rotatable with respect to each other and also are rotatable as a unit. A trailing edge of a sheet to be turned over is grasped between the sheet gripper fingers and abutment surfaces of a leading one of the cooperating pair of gripper sets. As the sheet turn-over drum rotates, the leading gripper set and the trailing gripper set each rotate so that their initially spaced gripper sets are now adjacent. The sheet's trailing edge is then transferred from the first set of grippers to the second set of grippers which then rotate away from the first set. Thus the sheet is turned over and its trailing edge is delivered to the second printing press.

Each of the gripper sets in the at least one cooperating pair of sets carried on the surface of the sheet turn-over drum is caused to rotate by suitable gear sets and rollers which are caused to turn operating levers by being brought into contact with camming surfaces. Only the gripper fingers and gripper finger abutment surfaces in each gripper set move outwardly from the surface of the sheet turn-over drum. Thus there is very little centrifugal force created and the operating speed of the sheet turn-over drum can be kept high. This allows the second printing unit to be fed with sheets at a high rate of speed so that the speed of operation of the printing assembly will stay high. Further, since the gripper finger shafts and the gripper finger abutment shafts do not move radially with respect to the sheet turn-over drum, they can be kept quite large and durable. This eliminates any possible problems that might arise from the use of small shafts, as was done in the prior art devices. Additionally, the positioning of the gripper shafts within the periphery of the sheet turn-over drum allows the use of leading or trailing drums or cylinders as are customarily used in first form printing.

The sheet turn-over assembly in accordance with the present invention allows increased press operating speeds and facilitate rapid and expeditious sheet turn-over. It is superior to prior art devices and represents a substantial improvement in the art.

BRIEF DESCRIPTION OF THE DRAWINGS

While the novel feature of the sheet turn-over assembly in accordance with the present invention are set forth with particularity in the appended claims, a full and complete understanding of the invention may be had by referring to the detailed description of the preferred embodiment which is set forth subsequently, and as is illustrated in the accompanying drawings in which:

DESCRIPTION OF THE PREFERRED EMBODIMENT

Figure 1:
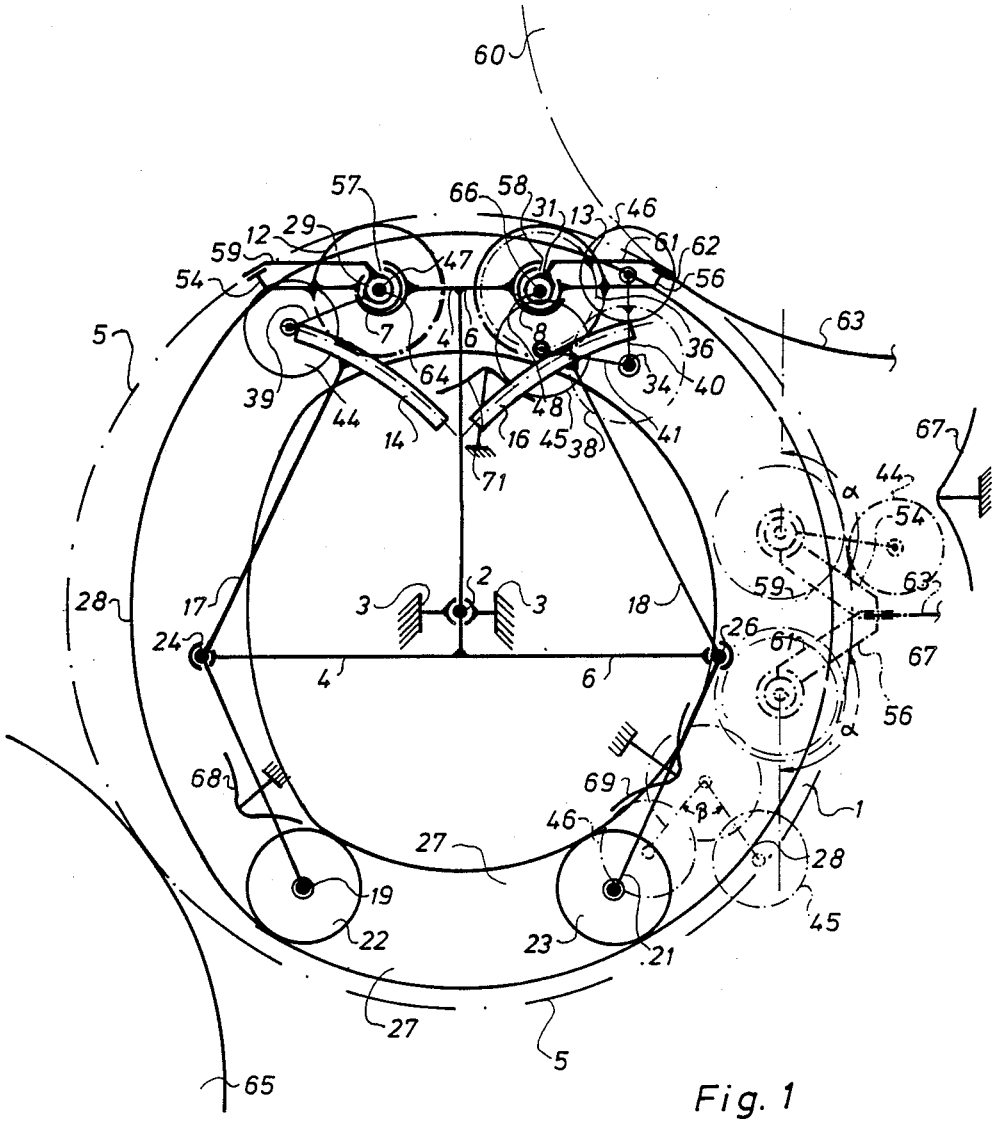
FIG. 1 is a schematic end view of the sheet turn-over assembly of the present invention and showing the drive and controls for opening and pivotal movement of the sets of grippers in accordance with the present invention.
Figure 2:
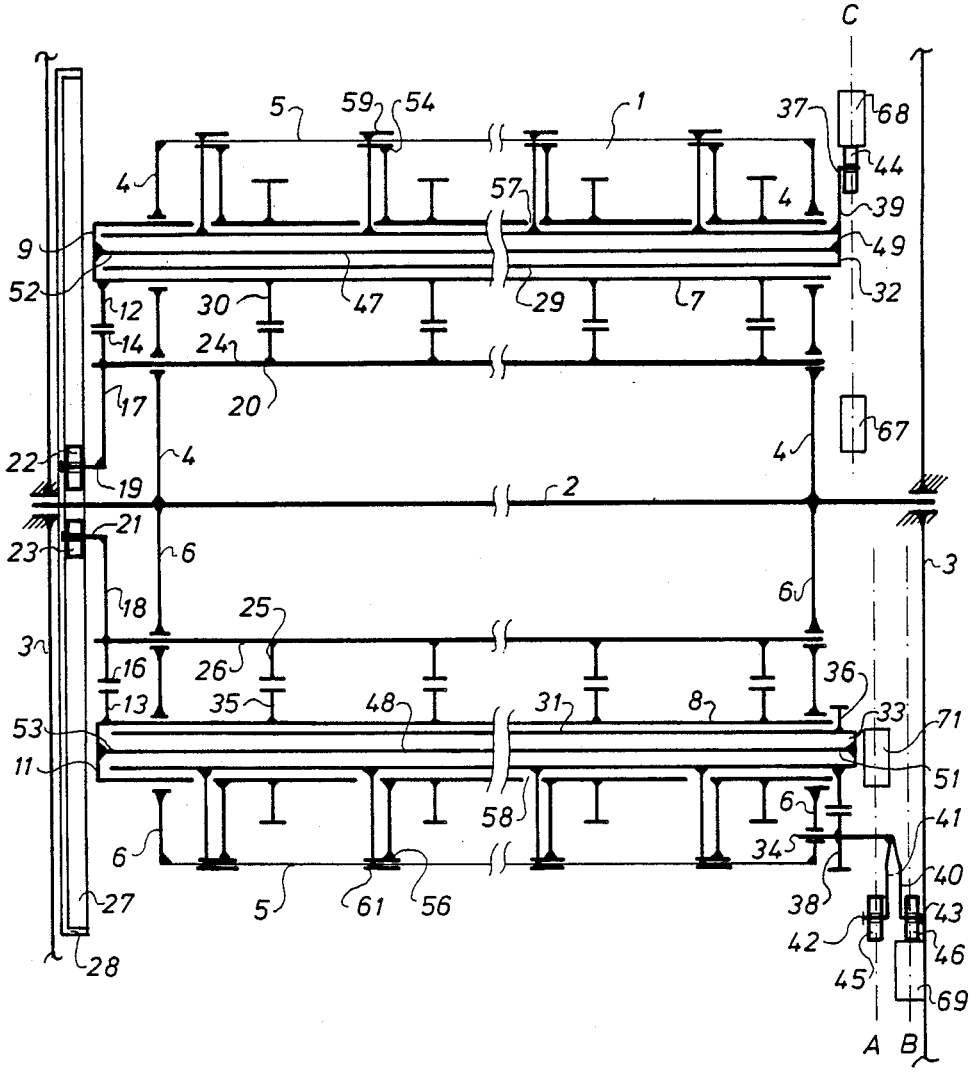
FIG. 2 is a schematic top plan view of the sheet turn-over drum and showing the gripper opening and pivoting drive assemblies.

Turning initially to FIG. 1, there may be seen a sheet turn-over drum generally at 1 in accordance with the present invention. Drum 1 is provided with a drive shaft 2 which is supported at its ends in the machine frame 3 of a sheet-fed rotary letterpress printing assembly for first and second form printing, as may be seen in FIG. 2.

A plurality of carrier segments 4 and 6 are fixed on the drive shaft 2. Within each of the carrier segments 4 and 6, a hollow gripper abutment shaft 7 or 8, respectively, is pivotably disposed within a periphery 5 of sheet turn-over drum 1. On the left ends 9 and 11 of the gripper abutment shafts 7 and 8 are disposed pinions 12 and 13. The pinions 12 and 13 each engage first ends of control levers 17 and 18, respectively, which are formed partially as curved toothed rods having toothed segments 14 and 16. On their second ends 19 and 21, the control levers 17 and 18 have pivotably supported control rollers 22 and 23. Control levers 17 and 18 further are fixedly connected at approximately their centers to ends of shaft 24 and 26, which are pivotably supported parallel to the shaft 2 in the carrier segments 4 and 6. Each of the shafts 24 and 26 has several toothed segments 20 or 25 distributed at intervals over their lengths and these are, in order to avoid possible torsional errors, in engagement with toothed wheels 30 and 35 that are fixed against torsional movement on the gripper abutment shafts 7 and 8.

Control rollers 22 and 23 engage an inner slot 27 of a control disc 28 and control the pivotal movement of the gripper abutments shafts 7 and 8 during second sheet operations. A hollow gripper finger shaft 29 or 31 is pivotably supported in each of the hollow gripper abutment shafts 7 or 8, respectively and extends with its right end 32 or 33 out of the right end of its gripper abutment shaft 7 or 8. Each gripper abutment shaft 7 or 8 has a plurality of adjacently located gripper abutment surfaces 54 or 56 fixedly connected with the gripper abutment shafts 7 or 8. Each of the gripper abutment shafts 7 or 8 also has an opening 57 or 58 between each of the two gripper abutment surfaces 54 or 56 and through each of these openings a gripper finger 59 or 61 extends. The gripper fingers 59 or 61 are fixedly fastened to the grippe finger shaft 29 or 31 and cooperate with the gripper abutment surfaces 54 and 56. These gripper fingers 59 and 61, together with the gripper abutment surfaces 54 and 56, form the sheet transport devices which are, however, not in the form of clamp grippers.

The end 32 of the gripper finger shaft 29 is securely connected to a control lever 39 which has a pivotably supported control roller 44 on its upper end 37. During rotation of the sheet turn-over drum 1, this control roller 44 comes into sequential contact with two spaced cam segments 67 and 68 which cause the grippers fingers 59 to lift from the gripper abutment surface 54.

A first pinion 36 is located at the end 33 of the gripper finger shaft 31. This pinion 36 is in engagement with a second pinion 38 that is fastened on a shaft 34 pivotably supported in the carrier segments 6. The second pinion 38 is fixedly connedted to two control levers 40 and 41. The two control levers 40 and 41 are of equal length and have an opening angle B, as seen in FIG. 1. On each of the their ends 42 and 43 the control levers each support a pivotably seated control roller 45 and 46 which, for the purpose of opening the grippers during rotation of the sheet turn-over drum 1, rotate in two, different, adjacently located planes A and B and touch the cam segments 69 or 71 located in planes A or B. This insures that the control roller 45 can only come into contact with the cam segment 71 and the control roller 46 can only come into contact with the cam segment 69.

Figure 3:
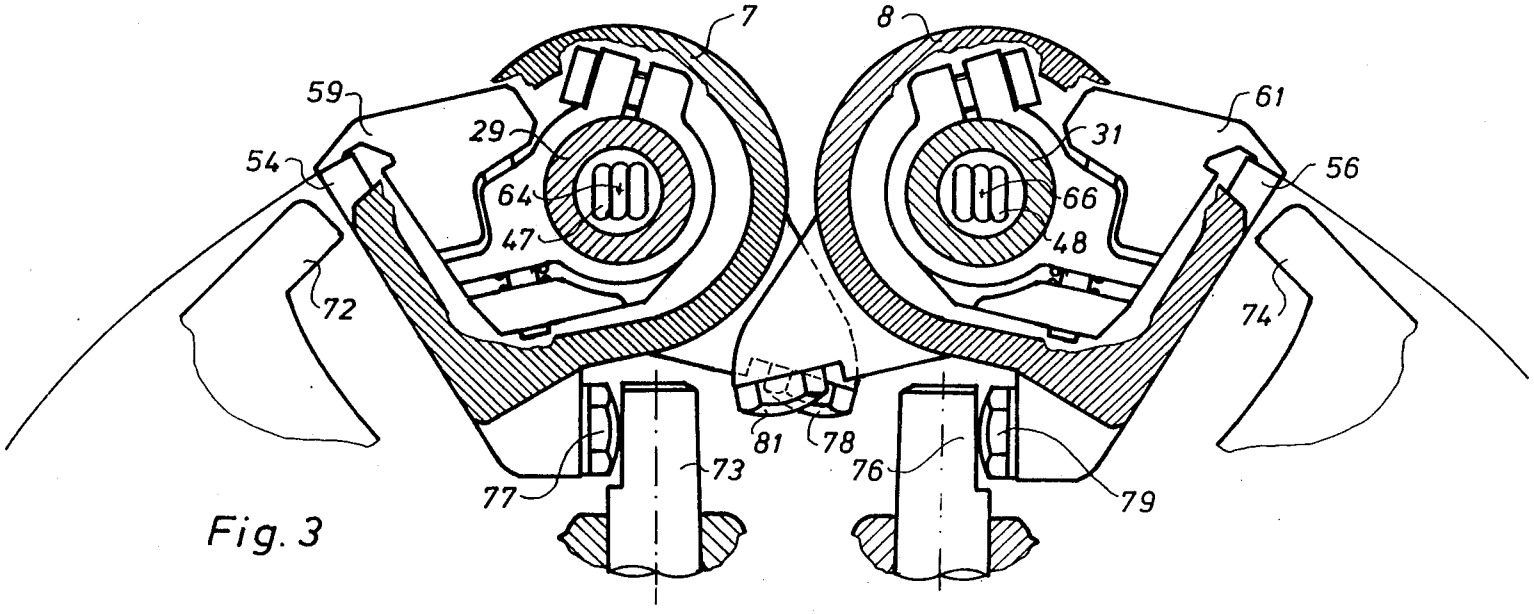
FIG. 3 is an enlarged partial side elevation view, partly in section, and showing a gripper set with associated stops for the pivotal movement of a sheet gripper set.

Gripper shafts 29 and 31 are each provided with an interiorly located torsion bar spring 47 or 48, respectively, as may be seen most clearly in FIG. 3. The right ends 49 and 51 of torsion bar springs 47 and 48 are secured to right ends 32 and 33 of the gripper finger shafts 29 and 31. Left ends 52 and 53 of torsion bar springs 47 and 48 are secured to left ends 9 and 11 of gripper abutment shafts 7 and 8, respectively. This means sthat a rotation of the gripper finger shafts 29 and 31 with respect to the gripper abutment shafts 7 and 8, as occurs when the gripper fingers 59 and 61 are moved with respect to the gripper abutment surfaces 54 and 56, is opposed by the torsion bar springs 47 and 48.

During sheet turn-over operation, the first gripper set 56 and 61, which consisting of gripper fingers 61 and gripper abutments 56, first grips a trailing edge 62 of a sheet 63 carried a storage drum 60. This first turn-over gripper set 56 and 61 is opened by the control roller 45 running against the gripper opening cam segment 71 in plane A. The control roller 45 is deflected in a clockwise direction by this cam 71 and pivots the gripper finger shaft 31 by means of a control lever 41 and the pinion 38 fastened on it, which engages the pinion 36, such that gripper finger shaft 31 is pivoted with respect to the gripper abutment shaft 8 and against the force of the torsion bar spring 48. When the control roller 45 loses contact with the cam segment 71, the gripper fingers 61 return to a "closed" position because of the return force of the torsion bar spring 48, and grip a trailing edge 62 of a sheet 63 on the storage drum 60.

During rotation of the sheet turn-over drum 1 in a clockwise direction, as seen in FIG. 1, the control roller 23 which runs in the inner slot 27 of the control disc 28 also rotates and pivots the control lever 18 and the shaft 26 in a clockwise direction. The toothed rod 16 at the first end of the control lever 18 pivots the pinion 13 and the gripper abutment shaft 8 to which it is attached, as well as the gripper finger shaft 31 about their common rotating axis 66 opposite to the direction of rotation of the sheet turn-over drum 1. At the same time, the gripper abutment shaft 7 and the gripper finger shaft 29 are pivoted in the direction of rotation of the sheet turn-over drum 1 around their common rotating axis 64 by the corresponding control roller 22, the control lever 17 and the toothed rod 14.

After a rotation of approximately 90° of the turn-over drum 1 and with pivot angles $\alpha$ for the two pairs of gripper sets, i.e., first set 56 and 61 and second set 54 and 59 each of approximately 120° around their respective rotating axes 64, 66; the trailing edge 62 of a first sheet 63 is transferred from the first, leading gripper set 56 and 61 to the second, trailing gripper set 54 and 59. For this purpose, the second gripper device 54 and 59 is opened first by means of the control roller 44, pivoted in the direction of rotation of drum 1 and coming into contact with can segment 67 disposed in a plane C, which is different from planes A and B. The trailing edge 62 of first sheet 63 is positioned between gripper finger 59 and gripper abutment surface 54 of the second gripper set and is gripped by them when the control roller 44 leaves the cam segment 67. Immediately thereafter, the first gripper set 56 and 61 is opened by the contact of the control roller 46 with the gripper opening cam segment 69 disposed in plane B, and releases the sheet 63. During further rotation of the turn-over drum 1 of approximately 90°0 the first and second gripper sets 56 and 61, and 54 and 59 pivot through the angle $\alpha$ back into their starting position so that the second gripper set completely turns the sheet 63 over and transfers it to gripper elements (not shown) of a consecutive second printing cylinder 65. An opening of the second gripper set 54 and 59 containing sheet 63 is started by the control roller 44, now facing in a direction opposite the turning direction of the turn-over drum 1, through contact with the cam segment 68 also disposed in the plane C. A review of FIG. 1 shows this above-discussed sequence of operation. As may be seen, sheet end 62 is initially grasped by first gripper set 56 and 61, and as sheet turn-over drum 1 rotates in a clockwise direction through about 90° to the point shown in phantom line in FIG. 1, the first gripper set 56 and 61 has turned in a counterclockwise direction through its angle $\alpha$ of approximately 120° while the second gripper set 54 and 59 has rotated through its angle $\alpha$ in a clockwise direction of also about 120°. This brings the two gripper sets into adjacency so that the trailing end 62 of sheet 63 can be transferred from the first gripper set to the second, as discussed above. Once this has been accomplished, and as sheet turn-over drum 1 continues to rotate through about another 90°, the two gripper sets move back down toward the periphery 5 of drum 1 through their angles $\alpha$ of about 120°. This effects a turn-over of sheet 63.

The common pivot angle $\alpha$ of approximately 120° of the gripper abutment shafts 7 and 8 and of the gripper finger shafts 29 and 31 is delimited by two sets of stops 72, 73 and 74, 76 which are fixed to the turn-over drum 1, and on which fixed counter stops 77, 78, 79, 81, fixed on the gripper abutment surfaces 54 and 56, impact at their respective pivot end positions. These two sets of end stops 72, 73; and 74, 76 as well as their cooperating fixed counter stop pairs 77, 78; and 79, 81 may be seen in FIG. 3.

When it is desired to operate the sheet turn-over assembly of the present invention in a first form printing operation the pivot drive for this first sheet gripper set 56 and 61 may be disconnected in a generally conventional manner. In such a configuration, the second or trailing gripper set 54 and 59 operates to transfer the sheet 63 from the storage drum 60 to the second printing cylinder 65.

While a preferred embodiment of a sheet turn-over assembly in accordance with the present invention has been fully and completely set forth hereinabove, it will be apparent to one of skill in the art that a number of changes in, for example, the type of printing cylinders used, the size of the sheet turn-over drum, the particular configuration of the sheet gripper fingers and sheet abutment surfaces, the types of bearings and rollers used, and the like may be made without departing from the true spirit and scope of the present application which is accordingly to be limited only by the following claims.

What is claimed is:

1. A sheet turn-over assembly for a sheet transfer apparatus positioned between first and second printing units in a sheet-fed rotary printing machine, said sheet turn-over assembly comprising:

a rotatable sheet turn-over drum positioned, in the direction of sheet transfer in the sheet transfer apparatus, after a sheet storage drum which receives sheets from the first printing unit, and before the second printing unit;

at least a first pair of cooperating first and second sheet gripper sets, said first sheet gripper set being pivotable about a first, radially fixed pivot axis and said second sheet gripper set being pivotable about a second, radially fixed pivot axis, each of said first and second sheet gripper sets being rotatably carried by said sheet turn-over drum and within the periphery of said sheet turn-over drum;

each of said first and second sheet gripper sets having coacting sheet gripper fingers and sheet abutment surfaces, said gripper fingers in each of said sets being carried on a gripper finger shaft, and said abutment surfaces in each of said sets being carried on an abutment surface shaft, said gripper finger shaft and said abutment surface shaft for each of said first and second sheet gripper sets being coaxially aligned shafts which are positioned one within the other and rotatable with respect to each other while being carried by said rotatable sheet turn-over drum;

first and second control rollers carried by said first sheet gripper set for actuation of said first sheet gripper finger shaft, said first and second control rollers being rotatable in first and second separate adjacent planes to contact first and second separate gripper opening cam segments in said first and second separate adjacent planes to open said first sheet gripper set twice during each complee rotation of said sheet turn-over drum to initially grasp a trailing end of a sheet being transferred from said first printing unit and to subsequently release the sheet to said second sheet gripper set;

a third control roller carried by said second sheet gripper set for actuation of said second sheet gripper finger shaft, said third control roller being rotatable in a third plane to contact third gripper opening cam segments in said third plane to open said second sheet gripper set twice during each complete rotation of said sheet turn-over drum to initially receive the trailing edge of a sheet being transferred from said first sheet gripper set and to subsequently release the sheet to said second printing unit; and means for pivoting said first and said second sheet gripper sets in said at least first cooperating pair in opposing directions about their said first and second radially fixed pivot axes with respect to each other to periodically bring said first and second sheet gripper sets into adjacency to effect the transfer of the trailing edge of the sheet being transferred from said first gripper set to said second gripper set, and to separate said first and second sheet gripper sets once sheet transfer to said second gripper set has been accomplished.

* * * * *